US007267701B2

(12) United States Patent
Holzschuh

(10) Patent No.: US 7,267,701 B2
(45) Date of Patent: Sep. 11, 2007

(54) TIBN COATING

(75) Inventor: Helga Holzschuh, Mehrstetten (DE)

(73) Assignee: Walter Aktiengesellschaft, Tubingen (DE)

( * ) Notice: Subject to any disclaimer, the term of this patent is extended or adjusted under 35 U.S.C. 154(b) by 291 days.

(21) Appl. No.: 10/442,138

(22) Filed: May 21, 2003

(65) Prior Publication Data

US 2004/0016329 A1 Jan. 29, 2004

(30) Foreign Application Priority Data

May 21, 2002 (DE) ..... 102 22 347

(51) Int. Cl.
*B32B 9/00* (2006.01)

(52) U.S. Cl. ..... 51/307; 51/309; 428/323; 428/336; 428/698; 428/701; 428/702; 428/704

(58) Field of Classification Search ..... 428/698, 428/704, 323, 701, 702, 336; 51/307, 309
See application file for complete search history.

(56) References Cited

U.S. PATENT DOCUMENTS

| | | | | |
|---|---|---|---|---|
| 4,239,536 | A * | 12/1980 | Yamamoto et al. | 428/548 |
| 4,746,563 | A * | 5/1988 | Nakano et al. | 428/217 |
| 4,895,770 | A * | 1/1990 | Schintlmeister et al. | 428/704 |
| 5,624,766 | A * | 4/1997 | Moriguchi et al. | 407/119 |
| 5,851,680 | A * | 12/1998 | Heau | 428/698 |
| 6,183,846 | B1 * | 2/2001 | Moriguchi et al. | 428/698 |
| 6,492,011 | B1 * | 12/2002 | Brandle et al. | 428/336 |

FOREIGN PATENT DOCUMENTS

| | | | |
|---|---|---|---|
| AU | 387 988 | B | 4/1989 |
| DE | 43 43 354 | A1 | 6/1995 |
| DE | 101 20 046 | A | 10/2002 |
| EP | 0 732 423 | B1 | 6/2001 |
| FR | 2370551 | * | 7/1978 |
| JP | 58209553 | * | 5/1982 |
| JP | 59059879 | * | 4/1984 |
| JP | 61041768 | * | 2/1986 |
| JP | 61195975 | * | 8/1986 |
| JP | 61272380 | * | 12/1986 |
| JP | 10176288 | * | 6/1998 |
| JP | 2001-293601 | * | 10/2001 |

OTHER PUBLICATIONS

Mollart et al "Tribological behavior of homogeneous Ti-B-N, Ti-B-N-C and (Tin/h-BN/TiB multilayer coatings" Surface and Coating Tech 86-87 (1996) 231-236.*

Mollart et al "An EXAFS and XRD study of the structure on nanocrystalline Ti-B-N thin films" J. Phys.Appl. 30 (1997) 1827-1832.*

Mollart, T.P., "Tribological behaviour of homogeneous Ti-B-N, Ti-B-N-C and TiN/h-BN/$TiB_2$ multilayer coatings." Surface and Coatings Technology (1996) 86-87 (1-3), 231-236.

* cited by examiner

*Primary Examiner*—Archene Turner
(74) *Attorney, Agent, or Firm*—Drinker Biddle & Reath LLP

(57) ABSTRACT

A TiBN layer is provided as a coating, in particular for cutter bodies, which is a mixed phase consisting of TiN and $TiB_2$. The boron content is 6 At.≧weight-%. The deposition rate is higher than that of a TiN layer and also higher than that of a $TiB_2$ layer. Hardnesses between 3500 HV to 5000 KV are achieved.

20 Claims, 1 Drawing Sheet

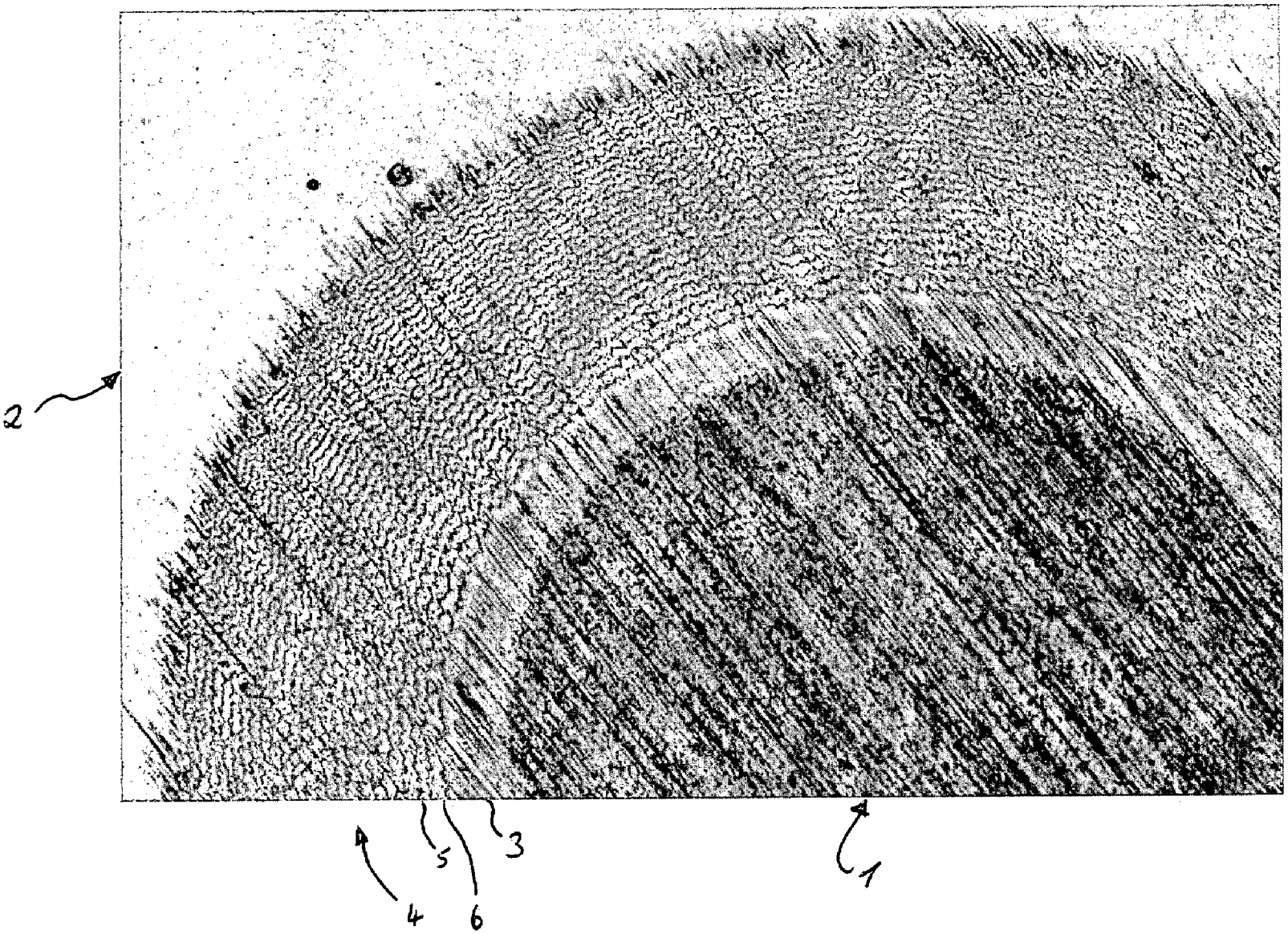
1
2
3
4
5
6

TIBN COATING

FIELD OF THE INVENTION

The invention relates to a cutter insert or a cutting tool, in particular for machining workpieces, as well as to a method for producing a coating to be provided on this cutting tool.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Hard material layers for reducing wear, for reducing friction or for similar purposes are known in different compositions and production methods. Titanium-boron nitride layers (TiBN layers) in particular are known. In this connection, DE 43 43 354 A1 discloses the production of TiBN layers by means of the PVD process. The TiBN layer is created by PVD vaporization of titanium boride at a coating temperature of approximately 200° C. The deposition of titanium boride takes place from a coating plasma.

It is difficult to integrate the PVD production of a TiBN layer into a process which produces other layers by means of the CVD process.

Layer structures containing TiBN layers are known from EP 0 732 423 B1. The TiBN layers are intended as intermediate layers between other layers for improving adhesion. The layers are created at a deposit temperature of 1000° C. by means of a CVD process.

The creation of a TiBN layer which consists of the layered components $TiN_X$ and $TiB_2$ is known from a publication of Bartsch, Leonhardt, Wolf entitled "Composition Oscillations in Hard Material Layers Deposited from the Vapour Phase" in Journal de Physique IV, Colloque C2, Suppl. au Journal de Physique II, Vol. 1, September 1991. For generating these oscillating layers, the coating was performed in a cold wall reactor at a temperature of 1300 K (approximately 1000° C.) by means of the CVD process.

SUMMARY OF THE INVENTION

The invention includes a cutter body provided with a very hard coating, methods of using the same, and a method for producing such hard layers.

According to the present invention, there is provided a cutter comprising: a base with a coating, the coating comprising at least one TiBN layer with a boron content of greater than or equal to 6 At %.

According to another aspect, the present invention provides a method for producing a hard material layer comprising positioning a body to be coated is in a reactor at a process pressure of 60 to 950 mbar and at a temperature between 700° C. and 1050° C., wherein the process atmosphere contains precursors of titanium and boron, as well as nitrogen and/or nitrogen compounds, and depositing at least one hard material layer.

BRIEF DESCRIPTION OF THE DRAWING

The FIGURE is a magnified image of a partial cross-section of a coated structure formed according to the present invention.

DETAILED DESCRIPTION OF THE INVENTION

A cutter body in accordance with the invention has a base body with a coating, which is constituted of a TiBN layer or contains such a layer, and has a boron content of ≧6 At %. Such a layer can attain a hardness of more than 4500 HV100. It has also been found that such a layer adheres well to carbon-containing base materials, such as tungsten carbide, or other layers which can be penetrated by carbon from the base material. It is therefore possible to produce cutter inserts or cutting tools with excellent metal-cutting properties.

The TiBN layer is preferably a mixed-phase layer of TiN and $TiB_2$. For example, the mixed-phase layer consists of a cubic TiN base lattice, into which $TIB_2$ crystals have been embedded. By means of this adhesion, problems as a result of carbon diffusion from a hard metal, such as tungsten carbide, into the coating are prevented. If boron is diffused out of the deposited layer into the hard metal, and if this leads to the formation of CoWB, the carbon being freed can be absorbed by the cubic TiN lattice without causing adhesion problems.

The TiN layer can also have boron contents in such an amount that it becomes a $TiB_2$ layer with embedded TiN crystals. Particularly great hardnesses can be achieved here.

The TiBN layer is preferably composed in such a way that one half, or slightly more than one half, of the portion of the mixed phase is in the form of $TiB_2$, while the remaining portion is in the form of TiN. The TiN portion assures a good insensitivity to diffusing carbon, which is mobilized in particular at higher coating temperatures.

The layers are preferably deposited in a CVD process. By means of this the TiBN layer can be integrated into a layer structure which is created as a whole by the CVD process. Conventional CVD installations can be used. No means for plasma creation or target evaporation are required. The TiBN layer can be directly deposited on a base material of tungsten carbide. The adhesion is not negatively affected by carbon diffusion if the applied layer contains a cubic TiN lattice. Moreover, the TiBN layer can be deposited on an aluminum oxide layer. In this case it can be used as a cover layer. Tests have shown that in lathe tools for machining castings a layer structure of a cover layer of TiBN on α-aluminum oxide results in an extension of the service life of 20% in comparison with cutting tools with a TiN-covered α-aluminum oxide layer without TiBN coating. By varying the process gases it is possible to achieve a multi-layered coating, in which thin TiN layers alternate with TiBN layers. These layers display superior metal cutting properties. Such layers are in particular not susceptible to thermal cracking. This is credited to the alternation of softer TiN layers with harder TiBN layers. It is possible to provide up to fifty layers per μm of layer thickness.

The method of the invention is a CVD process in which a lower process temperature of 700° C. to 1050° C. is employed. The process temperature preferably lies below 950° C., for example at 850° C. The process atmosphere contains precursors of titanium and boron, as well as nitrogen and/or nitrogen compounds. The deposition rate of titanium boron nitride is higher here than the deposition rate of titanium nitride or titanium boride by themselves. This allows the CVD deposition at relatively low temperatures. The lower temperatures result in only low carbon diffusion rates, which results in a smooth attractive appearance of the layer.

$TiCl_4$ is preferably provided as a precursor of titanium. $BCl_3$ is preferably employed as a precursor of boron. Preferably 0.9 to 1.5 vol-% of $TiCl_4$ and 0.9 to 2.5 vol-% of $BCl_3$ are set as the proportions in the process atmosphere. The nitrogen content of the process atmosphere is preferably 14 to 17 vol-%. The remaining portion of the process atmosphere is preferably hydrogen.

The process pressure can be fixed between 60 and 950 millibar. The deposition temperature can be fixed in the range between 700° C. and 1050° C. The $BCl_3$ content of the process atmosphere lies between 0.05 vol-% and 5 vol-%.

A TiBN layer is provided as a coating for cutter bodies in particular, which is a mixed phase consisting of TiN and $TiB_2$. The boron content is ≧6 At %. The deposition rate is higher than that of a TiN layer, and also higher than that of a $TiB_2$ layer. Hardnesses of more than 4000 HV are attained.

A cutter plate is partially shown in the sole FIGURE, whose surface has been ground by means of a grinding body in the shape of a universal ball joint. The ground section shows a central gray area 1 at the right bottom of the FIGURE, in which the base material, for example tungsten carbide, has come to the surface. In the undisturbed area 2 (upper left) the unaffected surface can be seen, which consists of TiBN. Directly adjoining the substrate, a TiN layer 3 of a thickness of approximately 1 μm is found. The multi-layer cover 4 located on top of it has a thickness of approximately 6 μm. It consists of approximately thirty layers, wherein a TiBN layer 6, which is respectively three to five times as thick, lies on a comparably thin TiN layer 5. The TiBN layers 6 are preferably mixed phase layers consisting of TiN and $TiB_2$. 50 to 60% of the mixed phase is present as titanium boride ($TiB_2$). The TiN layers 5 are preferably of identical thickness. If the thicknesses appear to be different in the figure, this is a result of the spherical grinding.

The substrate temperature can be kept below 900° C. when producing this multi-layer coating. The multi-layer coating 4 shows excellent adhesion and an extremely smooth surface. The number of individual layers can be greater than fifty. The hardness corresponds to that of a TiBN layer and lies approximately at 3,800 HV. The internal stress of the layer is low, and a reduced susceptibility to thermal cracking during machining of hard and toughness is displayed in particular.

Further details of advantageous embodiments of the invention ensue from the following illustrative, non-limiting, examples.

EXAMPLE 1

A TiN layer of a thickness of 0.5 μm, for example, is first applied to a cutter body made of tungsten carbide in a CVD process. The cutter body is placed into a CVD reactor for this purpose, and the appropriate CVD process is performed. Following the deposition of the TiN layer, the reactor is filled with an atmosphere containing 1 vol-% of $TiCl_4$, 16 vol-% of $N_2$, 0.1 vol-% of $BCl_3$ and $H_2$ as the remainder at a deposition temperature of 850° C. A process pressure of 100 millibar is set. A TiBN layer of a thickness of 6 μm and of a metallic brassy color has been deposited after a process duration of 15 hours. The TiBN layer is a TiBN matrix in which $TiB_2$ crystals are embedded. The micro-hardness can be above 4500 HV.

EXAMPLE 2

The boron content of the TiBN layer can be increased by increasing the $BCl_3$ content of the process atmosphere. For example, a cutter body is initially provided with a TiN layer of a thickness of 0.5 μm by means of a CVD process in a CVD reactor. Thereafter a process atmosphere containing 1 vol-% of $TiCl_4$, 16 vol-% of $N_2$, 2.5 vol-% of $BCl_3$, with the remaining percentage portions as hydrogen, is set, and a coating process is performed at a process pressure of 100 millibar and a deposition temperature of 850° C. A silvery TiBN layer of 6 μm has been grown after three hours. It consists of a $TiBN_2$ matrix, in which TiN crystals or crystallites are embedded. If the diffusion of carbon into the TiBN layer can be kept low, great hardness and wear resistance can be achieved.

If needed, the process pressure can be set in the range between 60 and 950 millibar. The temperature affects the rate of deposition. In principle the temperature range between 700° C. and 1050° C. can be used. The $BCl_3$ content of the process atmosphere is set between 0.05 and 5 vol-%.

EXAMPLE 3

For producing a cutter body, for example for steel machining, the body is initially coated with a TiN layer of a thickness of 0.5 μm in a CVD reactor. In a second step, a medium temperature TiCN layer of 8 μm thickness is applied (process temperature=700 to 900° C.). The process is performed in the same reactor. In the third step a TiAlCNO layer of 0.8 μm thickness is applied by means of the CVD process in the same reactor. It is used as a bonding layer for an $Al_2O_3$ layer of 6 μm thickness, which is to be deposited in a fourth step. At the end of these four CVD coating steps in the same reactor, a TiBN layer of 2 μm thickness is applied in the fifth step. The 2 μm thick layer is grown in 270 minutes at a process pressure of 300 millibar, a deposition temperature of 850° C. and in a process atmosphere composed of 1 vol-% of $TiCl_4$, 16 vol-% of $N_2$, 0.1 vol-% of $BCl_3$, with the remainder being $H_2$. The layer is a titanium nitride matrix with embedded $TiB_2$ crystals. The layer looks metallically brassy.

EXAMPLE 4

As in the previously described example, a cutter body can be first coated with a TiN layer of 0.5 μm thickness, an NT-TiCN layer of 8 μm thickness, a bonding layer, for example a TiAlCNO layer of 0.8 μm thickness and an aluminum oxide layer ($Al_2O_3$) of 6 μm thickness. A TiBN layer of 2 μm thickness can be applied in the same reactor. The result is a layer of 2 μm thickness after a deposition time of 150 minutes at a process pressure of 600 millibar and a deposition temperature of 900° C. in a process atmosphere with 1.4 vol-% of $TiCl_4$, 15 vol-% of $N_2$, 0.15 vol-% of $BCl_3$, with the remainder being $H_2$. The layer has a metallic, bright yellow hue.

The described embodiments of the present invention are intended to be illustrative rather than restrictive, and are not intended to represent every possible embodiment of the present invention. Various modifications can be made to the disclosed embodiments without departing form the spirit or scope of the invention as set forth in the following claims, both literally and in equivalents recognized in law.

I claim:

1. A cutter comprising:

a base with a coating, the coating comprising at least one TiBN layer with a boron content of greater than or equal to 6 At %, wherein the TiBN layer is a mixed phase consisting essentially of crystalline TiN and crystalline $TiB_2$.

2. The cutter in accordance with claim 1, wherein the TiBN layer is deposited by means of a CVD process.

3. The cutter in accordance with claim 1, wherein the TiBN layer is deposited on a tungsten carbide base material.

4. The cutter in accordance with claim 1, wherein the TiBN layer is provided as the cover material of a layered structure.

5. The cutter in accordance with claim 4, wherein the TiBN layer is the cover layer.

6. The cutter in accordance with claim 1, wherein the TiBN layer is applied to an $Al_2O_3$ layer.

7. The cutter in accordance with claim 1, wherein the total thickness of the TiBN layer is at most 12 μm.

8. The cutter in accordance with claim 7, wherein the total thickness is 2 μm-5 μm.

9. The cutter in accordance with claim 1, wherein the coating is a multi-layered coating having at least twenty layers.

10. The cutter in accordance with claim 1, wherein the TiN has a cubic crystal structure.

11. The cutter in accordance with claim 10, wherein the $TiB_2$ has a hexagonal crystal structure.

12. A cutter comprising:

a base with a coating, the coating comprising at least one TiBN layer with a boron content of greater than or equal to 6 At %, wherein the TiBN layer is a mixed phase consisting essentially of crystalline $TiB_2$ and crystalline TiN, and wherein 40% to 60% of the mixed phase is TiN.

13. The cutter in accordance with claim 12, wherein the TiBN layer is deposited by means of a CVD process.

14. The cutter in accordance with claim 12, wherein the TiBN layer is deposited on a tungsten carbide base material.

15. The cutter in accordance with claim 12, wherein the TiBN layer is provided as the cover material of a layered structure.

16. The cutter in accordance with claim 15, wherein the TiBN layer is the cover layer.

17. The cutter in accordance with claim 12, wherein the TiBN layer is applied to an $Al_2O_3$ layer.

18. The cutter in accordance with claim 12, wherein the total thickness of the TiBN layer is at most 12 μm.

19. The cutter in accordance with claim 18, wherein the total thickness is 2 μm-5 μm.

20. The cutter in accordance with claim 12, wherein the coating is a multi-layered coating having at least twenty layers.

* * * * *